United States Patent [19]

Bullock

[11] 4,276,833

[45] Jul. 7, 1981

[54] RAILWAY TRUCK FRICTION STABILIZING ASSEMBLY

[75] Inventor: Robert L. Bullock, Lombard, Ill.

[73] Assignee: Standard Car Truck Company, Chicago, Ill.

[21] Appl. No.: 958,790

[22] Filed: Nov. 8, 1978

[51] Int. Cl.[3] ..... B61F 5/06; B61F 5/12; B61F 5/50

[52] U.S. Cl. ..... 105/197 DB; 105/193; 105/197 D

[58] Field of Search ..... 105/193, 197 D, 197 DB

[56] References Cited

U.S. PATENT DOCUMENTS

| | | | |
|---|---|---|---|
| 2,169,715 | 8/1939 | Webb | 105/197 DB |
| 2,827,987 | 3/1958 | Williams | 105/197 DB |
| 2,974,610 | 3/1961 | Quinn et al. | 105/197 DB |
| 3,575,117 | 4/1971 | Tack | 105/197 DB |
| 4,084,514 | 4/1978 | Bullock | 105/197 DB |

*Primary Examiner*—Randolph A. Reese
*Assistant Examiner*—Howard Beltran
*Attorney, Agent, or Firm*—Kinzer, Plyer, Dorn & McEachran

[57] ABSTRACT

A friction member for use in the bolster pocket of a stabilized railroad car truck having a bolster positioned within a side frame window has a slanted friction surface adapted to bear against a slanted wear surface within the bolster pocket and a vertical friction surface adapted to bear against a side frame wear surface. The slanted friction surface has a profile in a generally horizontal plane consisting of a central flat portion and adjoining outside arcuate portions. The flat portion has a width equal to twice the distance between the side frame center line and the point of rotation of the side frame relative to the bolster, with said point of rotation being selected such that, during side frame rotation, the distance from the side frame center line to the point of intersection of the plane of the vertical friction surface and the plane of the side frame wear surface is no greater than one half of said friction member horizontal thickness.

5 Claims, 5 Drawing Figures

12
36
32
18
-10-
40
38
40
22
20
30
22
20
30
40
38
40
24
18
32
12
29 fig.3.
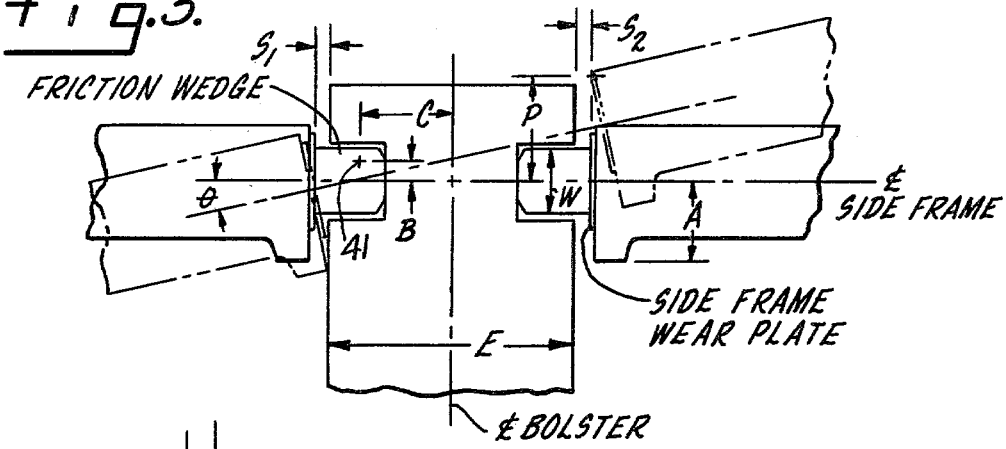
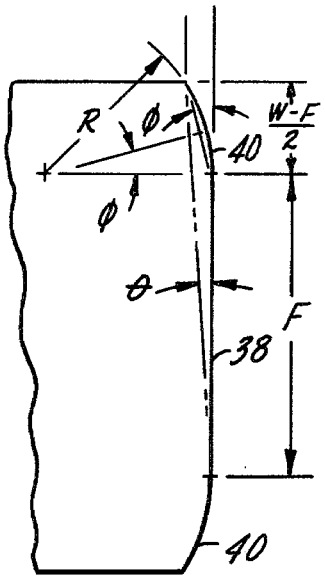
fig.4.
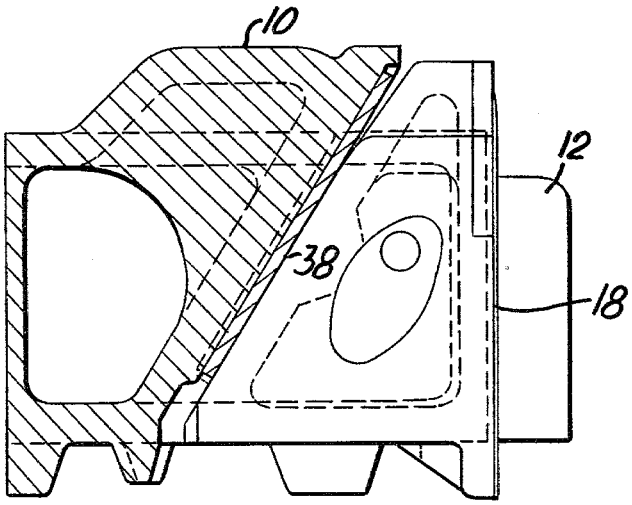
fig.5.

RAILWAY TRUCK FRICTION STABILIZING ASSEMBLY

SUMMARY OF THE INVENTION

The present invention relates to a friction member for use in the bolster pocket of stabilized railroad car trucks and in particular to a profile for the friction member slanted friction surface which will eliminate failures in the bolster caused by force applied by the friction member to the corner of the bolster pocket.

One purpose of the invention is an improved profile for a friction member slanted friction surface which will prevent the friction member from being jammed into the corner of the bolster pocket during relative rotation between the bolster and side frame.

Another purpose is a friction member which, through utilization of a specific profile for the slanted friction surface eliminates jamming and binding between the friction member and the bolster pocket.

Other purposes will appear in the ensuring specification, drawings and claims.

BRIEF DESCRIPTION OF THE DRAWINGS

The invention is illustrated diagrammatically in the following drawings wherein:

FIG. 3 is an exaggerated diagrammatic illustration of the relative rotation between the bolster and side frame during operation of a railroad car, FIG. 4 is an enlarged horizontal section illustrating the friction member profile, and FIG. 5 is a partial vertical section through a bolster and friction member illustrating a friction member vertical profile.

DESCRIPTION OF THE PREFERRED EMBODIMENT

Railroad car trucks having a friction member design somewhat similar to that shown in U.S. Pat. Nos. 3,575,117 and 4,084,514 have been a factor in certain bolster failures in cars repeatedly used in service in which there is substantial rotation of the side frame relative to the bolster. In particular, the failures occur at the inside interior corner of the bolster pocket, at times causing the bolster end to actually break off. These failures are particularly the result of service over what can be considered bad track in that there are extremely sharp curve areas subjecting the side frame to extreme rotational conditions relative to the bolster. Analysis has determined that extraordinarily high stresses are created within the bolster because the friction member or friction wedge is being jammed with enormous force into the corner of the bolster pocket 30. The stresses are above the yield point of the bolster material and are of such a magnitude as to actually swage or move the metal of the bolster at that point.

Figure 1:
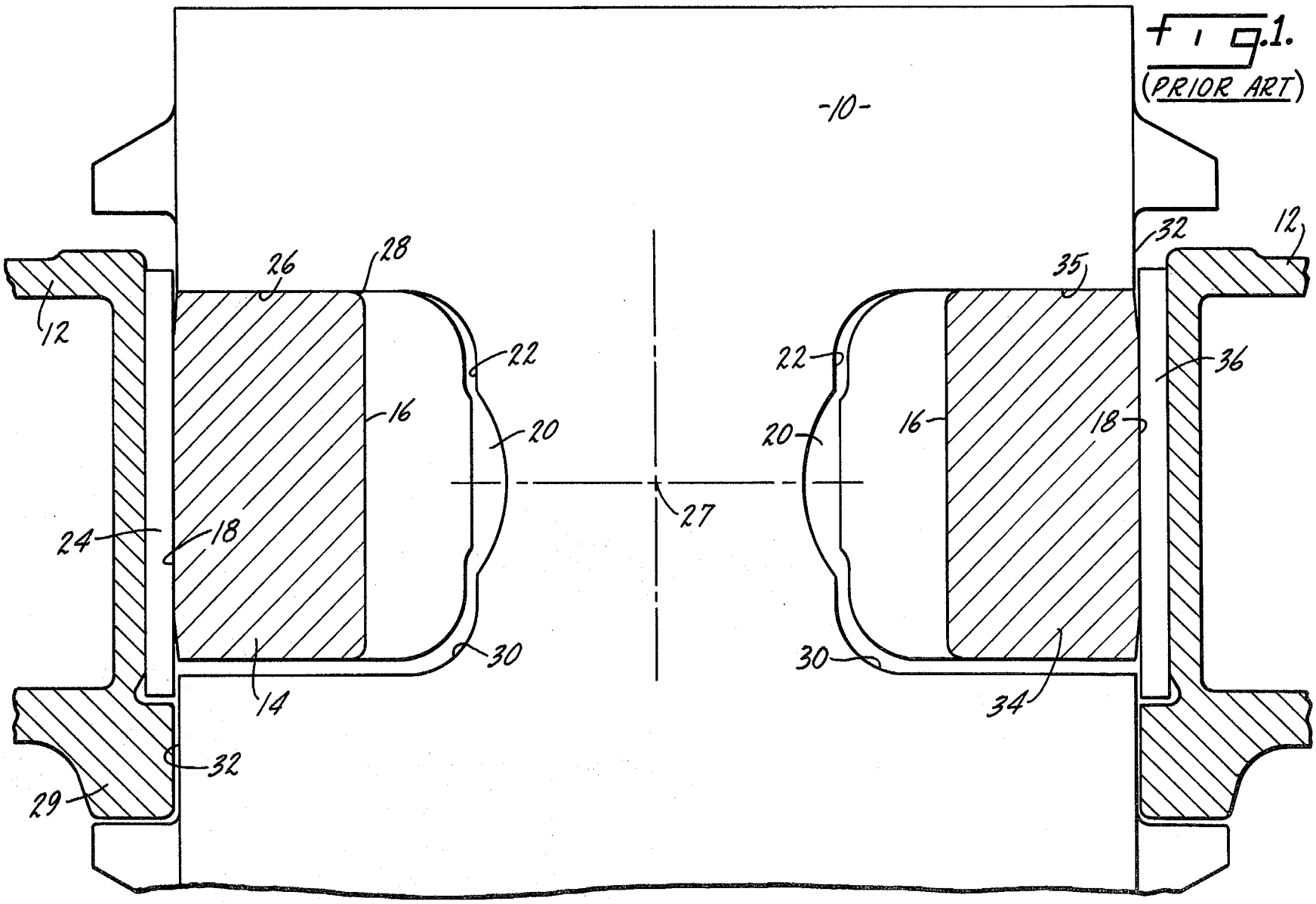
FIG. 1. (PRIOR ART)
FIG. 1 is a partial horizontal section through a side frame and bolster showing friction members of the prior art in position within the bolster pockets.

FIG. 1 is an illustration of the friction member of the prior art and is similar to the friction member disclosed in U.S. Pat. No. 4,084,514. The bolster is indicated at 10 and the side frame at 12. A friction member is indicated at 14 and has a slanted friction surface which has a profile in a horizontal plane represented by line 16 and a vertical friction surface represented by plane 18. Friction member 14 will be positioned within a bolster pocket 20 as is conventional. The bolster pocket may have a slanted wear surface 22 or there may be a wear plate within the bolster pocket. Side frame 12 carries a vertical wear plate 24 which cooperates with friction member surface 18 to provide the damping effect customary with a bolster-side frame-friction wedge construction as disclosed in FIG. 1.

Railroad engineers are not able to explain the reason, but during normal service, friction member 14 will assume the position of FIG. 1, that is, the friction member will be in contact with the exterior side 26 of the bolster pocket. The wedge is not centered and it is not known precisely why this takes place, but it has long been recognized in the art.

Railroad engineers have long assumed that during operation on curved track relative rotation between the side frame and bolster took place about an axis of rotation 27 coincident with the point of intersection of the side frame and the bolster center lines. Analysis of the above-described failures has indicated that in fact rotation does not take place at the described axis, but in reality takes place at approximately point 28 at the intersection of line 16 and the line of contact between the friction member and the exterior side of the bolster pocket. With rotation about this point, and assuming counterclockwise rotation, the friction member will be rotated in a counterclockwise direction by side frame 12 with the result that the friction member will be jammed into corner 30 of the bolster pocket with extraordinary force. This occurs because the friction member will be moved by the side frame until there is contact between the enlarged side frame area 29 and the opposing portion 32 of the bolster. Because of such movement of the friction member, the extraordinary forces described are present at corner 30, resulting in bolster failures of the type described.

At the same time that the left-hand friction member in FIG. 1 is undergoing the above-described movement, there is similarly damaging movement to right-hand friction member 34. Rotation about point 28 will cause right-hand wear plate 36 to move away from friction member 34. Since friction member 34 is supported by springs, removal of the horizontal force from wear plate 36 permits the friction member to move up in its pocket. However, as the side frame and bolster return to their original positions, friction member 34 cannot move down as the wedge pocket cannot squeeze it down. Thus, upon return of the members to their normal position, as shown in the drawings, and which would occur on straight track, friction member 34 will be forced against exterior side 35 of the bolster pocket causing unacceptable wear on both the pocket wall and friction member. In addition, such upward movement magnifies the forces applied by the friction member at the pocket corner during the next incident of side frame rotation in the opposite direction.

The present invention is specifically designed to relocate the axis of rotation between the bolster and side frame under curved track conditions to eliminate the extraordinary high forces applied by the friction member to the bolster pocket corner and to insure that during such side frame rotation the side frame wear plate does not move out of contact with the mating friction surface of the friction member, thus preventing the wedge from moving up in the bolster pocket.

Figure 2:
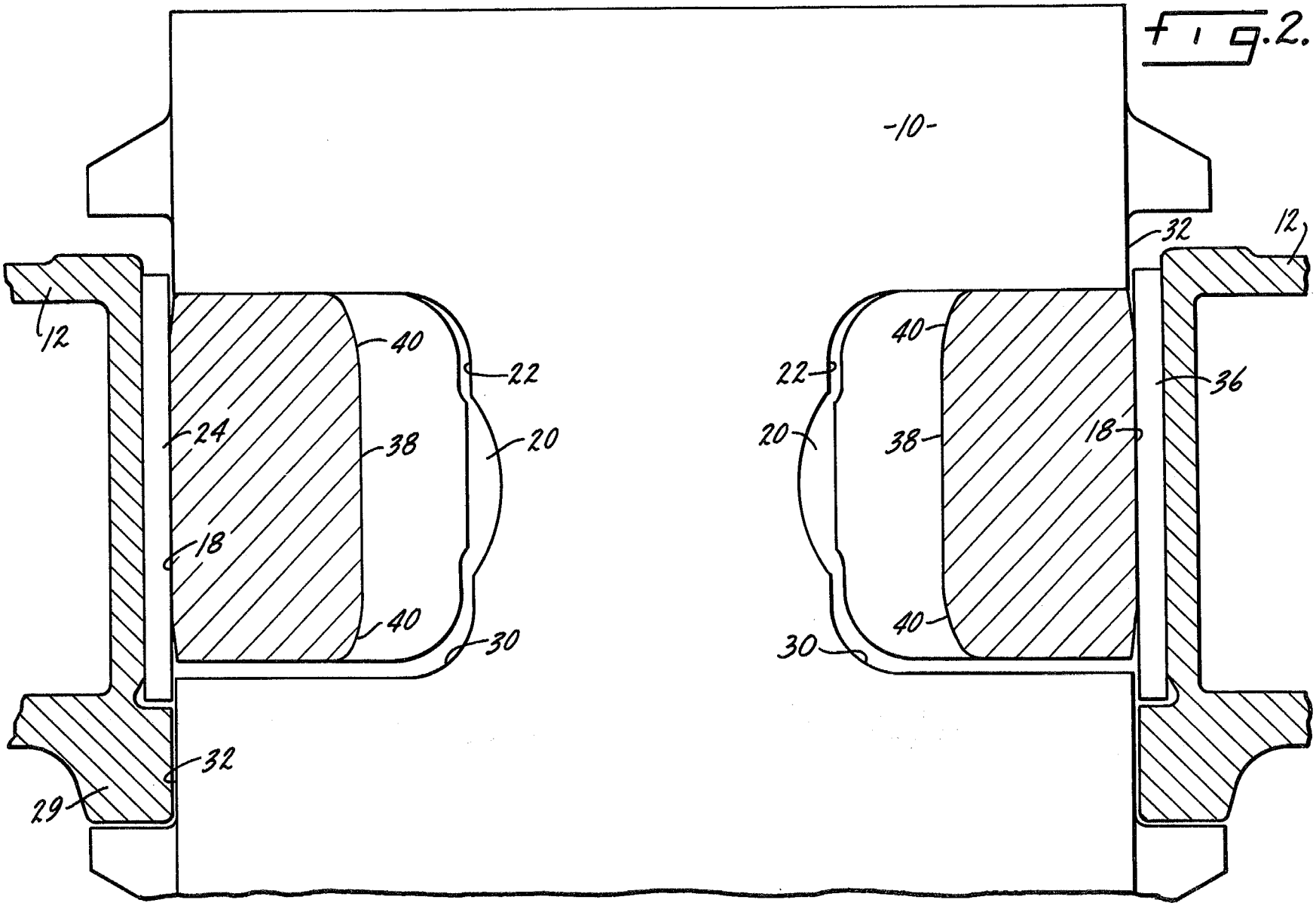
FIG. 2 is a partial horizontal section with portions of the cross hatching eliminated for clarity, similar to FIG. 1, but illustrating the friction members of the present invention within the bolster pockets.

In FIG. 2, the slanted friction surface of the friction member has a generally flat central portion 38 and adjoining exterior arcuate portions 40. Both FIG. 2 and FIG. 1 are generally horizontal sections through the friction members. The vertical profile of the friction members may be as disclosed in FIG. 5 which is the same as FIG. 2 in U.S. Pat. No. 4,084,514. The radius of curvature of the arcuate portion 40 and the width of the central portion 38 are important in the design of a friction member which will not cause excessive stress in the bolster pocket at corner 30 as illustrated in FIG. 1, or removal of pressure from the side frame wear plate 36 upon the friction member.

FIG. 3 is a diagrammatic illustration of movement between the side frame and bolster when the car truck passes through curved track. The side frame 12 will move from the full line position to the broken line position. The following designations apply to FIG. 3:

| | |
|---|---|
| E | Width of bolster. |
| $S_1 + S_2$ | Total clearance between bolster and side frame. |
| A | Distance from side frame centerline to edge of antirotation stop lug. |
| B | Distance from side frame centerline to point of rotation (41). |
| C | Distance from bolster centerline to point of rotation (41). |
| P | Distance from side frame centerline to intersection of plane of friction wedge and plane of side frame wear plate. |
| W | Width of friction wedge. |
| $\theta$ | Angle of rotation of side frame with respect to the bolster. |

Considering first the requirement that during such movement the side frame wear plate not be out of contact with the opposing vertical friction surface 18 of the friction member, certain criteria must be met. B must be selected such that P is equal to or less than W/2. With such an assumed relationship the formula for P becomes:

$$P = \left(\frac{E}{2} + S_2 + C\right) \text{TAN}\,\theta + \left[S_1 + (E + S_2)\left(1 - \frac{1}{\text{COS}\,\theta}\right)\right] \frac{1}{\text{SIN}\,\theta} - \sqrt{(A + B)^2 + S_1^2} + B \leqq \frac{W}{2}$$

where $\text{TAN}\,\theta = \frac{S_1}{A + B}$ $$\text{COS}\,\theta = \frac{A + B}{\sqrt{(A + B)^2 = S^2}}$$

$$\text{SIN}\,\theta = \frac{S_1}{\sqrt{(A + B)^2 + S_1^2}}$$

As an example, and using typical tolerance conditions as found in the field, the following dimensions are applicable:

Bolster width E=16–11/16"

Total clearance $S_1 + S_2 = 0.4375''$ $S_1 = s_2 = 0.21875''$

A=5-¾"

B=2"(4" wide flat)

W/2=3-½"(friction casting width 6-½")

Accordingly, when B is equal to 2", P is equal to 2.38667" and is less than W/2 which is 3-½". Therefore, the first requirement is met and during rotation of the side frame relative to the bolster the side frame wear plate will not move out of contact with the opposing surface on the friction member.

Using the same dimensions with the prior art design of the wedge slanted surface, as illustrated in FIG. 1, P equals 3.380 inches which is greater than the W/2 dimension of 3.25 inches.

The second requirement of the friction casting is that there not be binding or jamming contact at corner 30. This requirement can be met if there is contact between side frame area 29 and the adjoining bolster surface 32 prior to contact between the wedge arcuate portion 40 and the bolster corner. Using the designations of FIG. 4, the radius of curvature of arcuate portions 40, in order to meet the above criteria, is determined by the following formula where W equals the width of the wedge and F equals the width of flat portion 38:

$$R = (W\text{-}F)/4\ \text{COS}\ \phi\ \text{SIN}\ \phi$$

As indicated previously, the vertical cross section of the wedge can be as shown in U.S. Pat. No. 4,084,514, or it can be a totally crowned slanted friction surface. A horizontal plane through the wedge slanted friction surface will have the profile as shown in FIG. 2 with a central flat portion 38 and adjoining exterior arcuate portions 40. The width of portion 38 will meet the criteria described above. The radius of arcuate portions 40 will be consistent with the above formula for radius R. Both of these design requirements are important as they will prevent the wedge or friction member from assuming the described positions in the prior art structure which resulted in bolster failures.

Whereas the preferred form of the invention has been shown and described herein, it should be realized that there may be many modifications, substitutions and alterations thereto.

The embodiments of the invention in which an exclusive property or privilege is claimed are defined as follows:

1. A friction member for use in the bolster pocket of a stabilized railroad car truck having a bolster positioned within a side frame window, said friction member having a slanted friction surface adapted to bear against a slanted wear surface within the bolster pocket and a vertical friction surface adapted to bear against a side frame wear surface, said slanted friction surface having a profile in a generally horizontal plane through the bolster consisting of a central flat portion and adjoining outside arcuate portions, said flat portion having a width equal to twice the distance between the side frame center line and the point of rotation of the side frame relative to the bolster means positioning said point of rotation such that, during side frame rotation, the distance from the side frame center line to the point of intersection of the plane of said vertical friction surface and the plane of the side frame wear surface is no greater than one half of said friction member horizontal thickness.

2. The friction member of claim 1 further characterized in that the point of rotation is generally coincident with the junction of said flat portion and an arcuate portion.

3. The friction member of claim 1 further characterized in that said flat portion is centered at the centerline of the side frame.

4. The friction member of claim 1 further characterized in that said arcuate portions have a radius such that, during side frame rotation, there is contact between the side frame and bolster before the friction member arcuate portion contacts the an interior corner of the bolster pocket.

5. A friction member for use in the bolster pocket of a stabilized railroad car truck having a bolster positioned within a side frame window, said friction member having a slanted friction surface adapted to bear against a slanted wear surface within the bolster pocket and a vertical friction surface adapted to bear against a side frame wear surface, said slanted friction surface having a profile in a generally horizontal plane through the bolster consisting of a central flat portion and adjoining outside arcuate portions, said arcuate portions having a radius such that, during rotation of the side frame relative to the bolster, there is contact between the side frame and bolster before the friction member arcuate portion contacts an interior corner of the bolster pocket.

* * * * *